US009765521B1

(12) United States Patent
Abbas et al.

(10) Patent No.: US 9,765,521 B1
(45) Date of Patent: Sep. 19, 2017

(54) PRECAST REINFORCED CONCRETE CONSTRUCTION ELEMENTS WITH PRE-STRESSING CONNECTORS

(71) Applicant: KING SAUD UNIVERSITY, Riyadh (SA)

(72) Inventors: Husain Abbas, Riyadh (SA); Yousef A. Al-Salloum, Riyadh (SA); Tarek H. Almusallam, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 15/297,093

(22) Filed: Oct. 18, 2016

(51) Int. Cl.

| | |
|---|---|
| ***E04C 3/26*** | (2006.01) |
| ***E04B 1/22*** | (2006.01) |
| ***E04C 3/34*** | (2006.01) |
| ***E04C 5/08*** | (2006.01) |
| ***E04C 5/12*** | (2006.01) |
| ***E04C 5/10*** | (2006.01) |

(52) U.S. Cl.
CPC ..... *E04C 3/26* (2013.01); *E04C 3/34* (2013.01); *E04C 5/08* (2013.01); *E04C 5/10* (2013.01); *E04C 5/12* (2013.01); *E04B 1/22* (2013.01)

(58) Field of Classification Search
CPC ... E04C 3/26; E04C 5/10; E04H 9/025; E04H 9/027; E04B 1/21; E04B 1/22
See application file for complete search history.

(56) References Cited

U.S. PATENT DOCUMENTS

| | | | | |
|---|---|---|---|---|
| 4,607,470 | A | 8/1986 | Ecker | |
| 4,630,412 | A * | 12/1986 | Engstrom | E04B 1/98 52/1 |
| 6,119,425 | A * | 9/2000 | Shimonohara | E04B 1/21 264/267 |
| 6,256,943 | B1 * | 7/2001 | Mander | E04H 9/02 52/146 |
| 6,327,825 | B1 * | 12/2001 | Sanders | E04B 1/21 52/167.1 |
| 8,919,057 | B1 | 12/2014 | Dupray | |
| 2004/0065030 | A1 * | 4/2004 | Zambelli | E04B 1/21 52/223.13 |

(Continued)

FOREIGN PATENT DOCUMENTS

| | | | | |
|---|---|---|---|---|
| CN | 202055338 U | 11/2011 | | |
| FR | 2902814 A1 * | 12/2007 | | E04B 1/21 |

(Continued)

*Primary Examiner* — Christine T Cajilig
(74) *Attorney, Agent, or Firm* — Richard C. Ltman

(57) ABSTRACT

The precast reinforced concrete construction elements with pre-stressing connectors provide beam-column connections which are post-tensioned through a combination of active and passive pre-stressing tendons. The active pre-stressing tendons improve the efficiency and effectiveness of the beam-column connections under service loads, as well as during application of external forces and stresses, such as during earthquakes. The passive pre-stressing tendons are lightly pre-stressed and only become effective during progressive collapse of the building. Specifically, the passive pre-stressing tendons become stressed only during downward movement of a joint due to the loss/damage of a column, thus providing resistance against further downward movement of the joint and thereby resisting the progressive collapse.

6 Claims, 5 Drawing Sheets

(56) References Cited

U.S. PATENT DOCUMENTS

| | | | | | |
|---|---|---|---|---|---|
| 2015/0330095 | A1* | 11/2015 | Kurosawa | ..... | E04C 5/012<br>52/741.3 |

FOREIGN PATENT DOCUMENTS

| | | | | | | |
|---|---|---|---|---|---|---|
| GB | 836779 | A | * | 6/1960 | ..... | E04B 1/22 |
| JP | 1-198935 | A | | 8/1989 | | |
| JP | 2000230273 | A | * | 8/2000 | | |
| JP | 2009002101 | A | * | 1/2009 | | |
| KR | 10-2013-0074238 | A | | 7/2013 | | |

* cited by examiner

PRECAST REINFORCED CONCRETE CONSTRUCTION ELEMENTS WITH PRE-STRESSING CONNECTORS

BACKGROUND OF THE INVENTION

1. Field of the Invention

The present invention relates to building construction and the like, and particularly to precast, reinforced concrete construction elements with pre-stressing connectors for post-tensioning of beam-column joints.

2. Description of the Related Art

In construction of buildings or the like, beams are used to span between upstanding members, typically referred to as columns. The beams are adapted to carry loads, such as concrete floors and the like. Prior to advances made in the usage of reinforced concrete, beams and columns were typically made from steel, particularly due to its enhanced load bearing characteristics per unit weight. In addition to simple construction, in which steel beams (typically in the form of I-beams) are erected to span between columns and carry the designed loads, external post-tensioning of the steel beams may be added. External tensioning is accomplished by suitable location of the columns and by tensioning the beam to span therebetween.

Developments in the field of reinforced concrete has allowed for construction using reinforced concrete beams and columns, replacing (or used in addition to) steel construction elements. Unlike steel beams, reinforced concrete beams may be internally post-stressed or pre-stressed. To construct such concrete beams, a network of steel cables extends through and along the length of the beam. If the beam is to be pre-stressed, the cables are positioned in a mold, with the mold having steel plates at its ends. Hydraulic jacks or the like are then used to tension the cables in the mold. Thereafter, concrete is poured into the mold between the end plates to encase the cable network. After the concrete has sufficiently hardened, the tension cables are secured to the end plates and released to place the concrete beam in compression.

In post-stressing, the network of cables is positioned and concrete is poured thereabout, either in a mold or in situ to encase the cables. End plates are attached to the concrete beam, with certain cables extending therethrough. After the concrete is sufficiently hardened, the cables are tensioned and thereafter secured to the end plates and released to place the concrete beam in compression. The pre-stressing and post-stressing techniques are effective in enhancing the load bearing characteristics of the beam.

FIG. 2 illustrates a typical conventional pre-stressed construction element 114, in the form of a beam spanning between a pair of upstanding columns 112. To provide for connection of the beam 114 between columns 112, each column 112 has a connection plate 118 projecting therefrom. The exemplary conventional pre-stressed beam 114 of FIG. 2 is in the form of an I-beam, having a web 120 interconnected between two spaced flanges 122. To enhance the strength of the beam 114 so that relatively smaller and lighter beams may be used to support a given projected load, at least one tendon 124 extends longitudinally alongside the beam 114. Tendons 124 are adapted to be tensioned by placing the beam 114 under compressive forces, thus pre-stressing beam 114. Such tendons 124 are typically in the form of steel cables having a number of strands.

Although pre-stressing of beams, such as in beam 114, enhances the load bearing characteristics of the beam itself, such pre-stressing does not aid in enhancing the properties of the connections between the beams and the columns. It would be particularly desirable to be able to provide enhancement and reinforcement for beam-column connections to mitigate damage caused by earthquakes, building collapse and the like. Further, there are major concerns with regard to precast, reinforced concrete buildings due to their vulnerability to progressive collapse during the event of column loss/damage due to blast loads. This vulnerability is mainly due to the weakness of the connections in precast, reinforced concrete frames, especially when a beam-column joint moves downward because of the removal/damage of the column connected to the joint. It would obviously be desirable to be able to improve the beam-column joints/connections. Thus, precast, reinforced concrete construction elements with pre-stressing connectors solving the aforementioned problems is desired.

SUMMARY OF THE INVENTION

The precast, reinforced concrete construction elements with pre-stressing connectors provide beam-column connections which are post-tensioned through a combination of active and passive pre-stressing tendons. The active pre-stressing tendons improve the efficiency and effectiveness of the beam-column connections under service loads, as well as during application of external forces and stresses, such as during earthquakes. The passive pre-stressing tendons are lightly pre-stressed and only become effective during progressive collapse of the building. Specifically, the passive pre-stressing tendons become stressed only during downward movement of a joint due to the loss/damage of a column, thus providing resistance against further downward movement of the joint and thereby resisting the progressive collapse.

The reinforced concrete construction elements include first and second beams, with each beam having longitudinally opposed first and second ends, a top face and a bottom face. The first ends of each of the first and second beams are secured to a central column, which has at least two passive ducts, for passive pre-stressing tendons, and at least two active ducts, for active pre-stressing tendons, formed therethrough.

Each passive pre-stressing tendon has opposed first and second ends and a substantially U-shaped contour. The first end thereof is anchored to the top face of the first beam, and the second end thereof is anchored to the top face of the second beam. A central portion passes through a corresponding one of the passive ducts formed through the beams and column. Similarly, each active pre-stressing tendon has opposed first and second ends and a substantially inverted U-shaped contour. However, the first end thereof is anchored to the bottom face of the first beam, and the second end thereof is anchored to the bottom face of the second beam. A central portion thereof passes through a corresponding one of the active ducts formed through the beams and column.

These and other features of the present invention will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
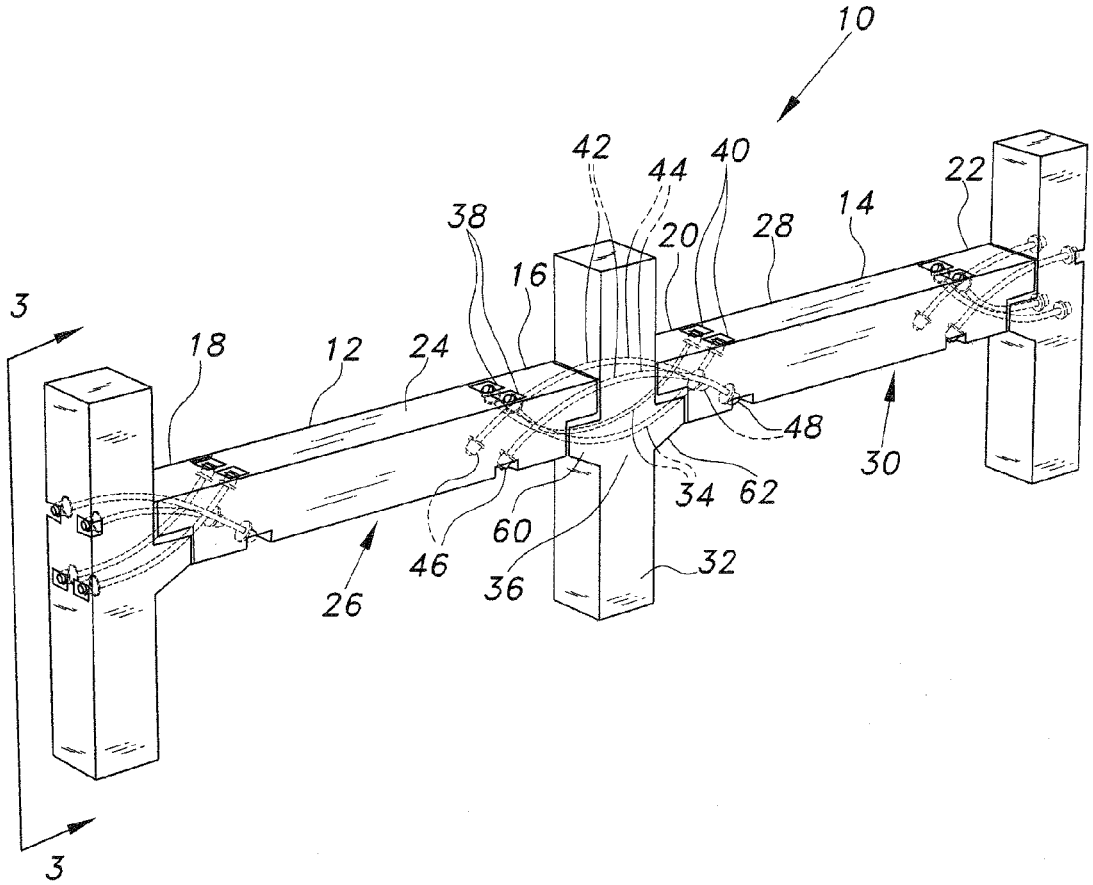
FIG. 1 is a perspective view of reinforced concrete construction elements with pre-stressing connectors according to the present invention.
Figure 2:
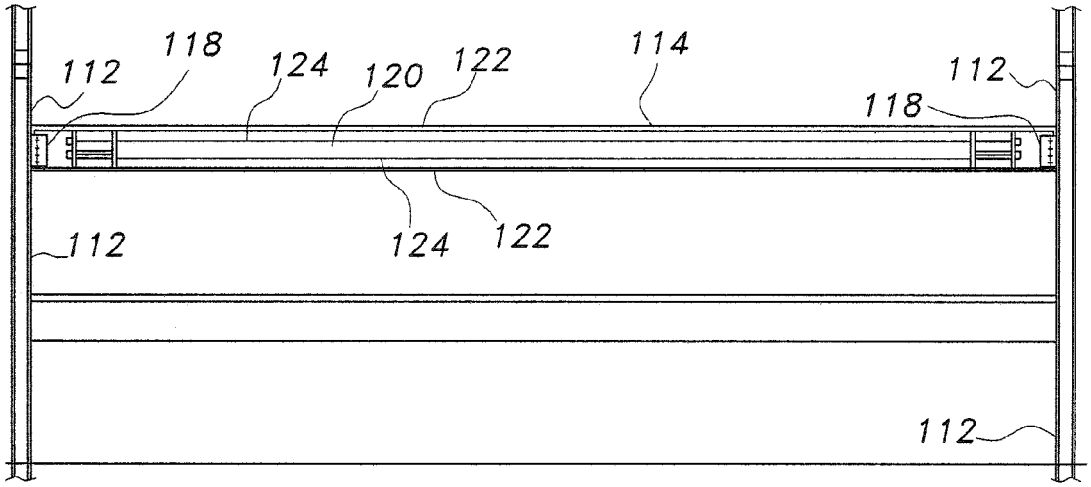
Prior Art FIG. 2
FIG. 2 illustrates a conventional prior art construction element with pre-stressing tendons.

The precast reinforced concrete construction elements with pre-stressing connectors 10 provides beam-column connections which are post-tensioned through a combination of passive and active pre-stressing tendons 34, 42, respectively, as shown in FIG. 1. The active pre-stressing tendons 42 improve the efficiency and effectiveness of the beam-column connections under service loads, as well as during application of external forces and stresses, such as during earthquakes. The passive pre-stressing tendons 34 are lightly pre-stressed and only become effective during progressive collapse of the building. Specifically, the passive pre-stressing tendons 34 become stressed only during downward movement of a joint, thus providing resistance against further downward movement of the joint and thereby resisting the progressive collapse.

Figure 3:
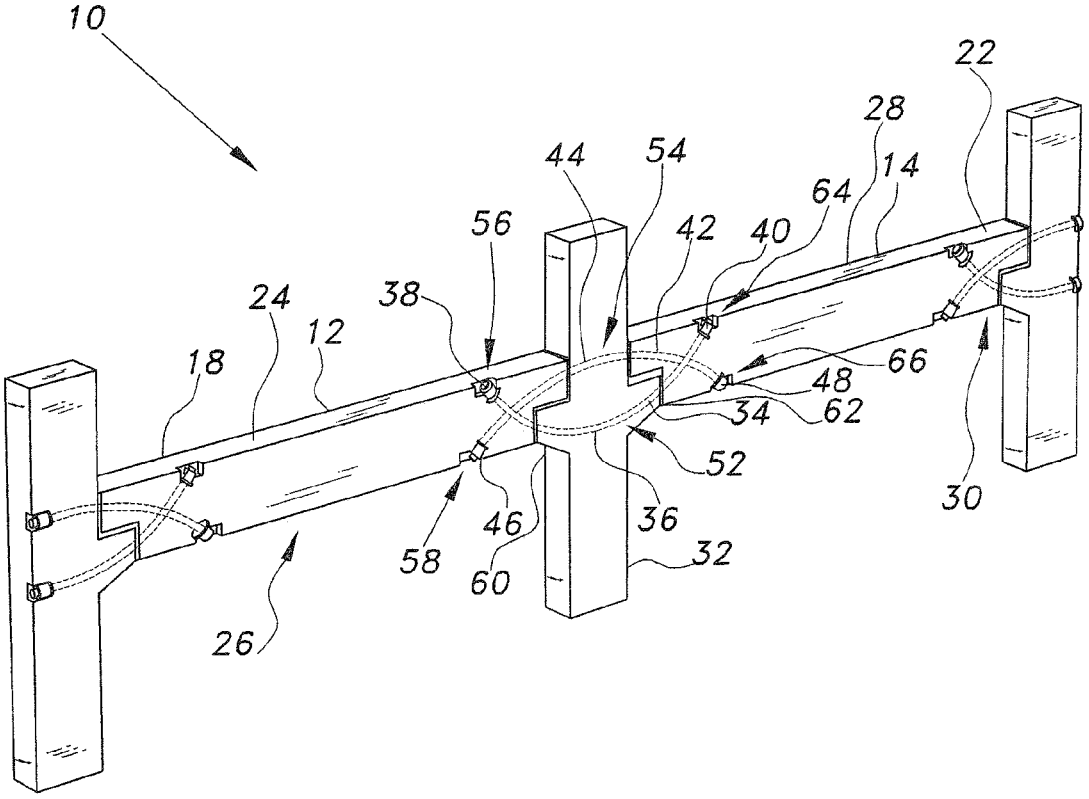
FIG. 3 is a sectional view, taken along sectional lines 3-3, of the reinforced concrete construction elements with pre-stressing connectors of FIG. 1.
Figure 6:
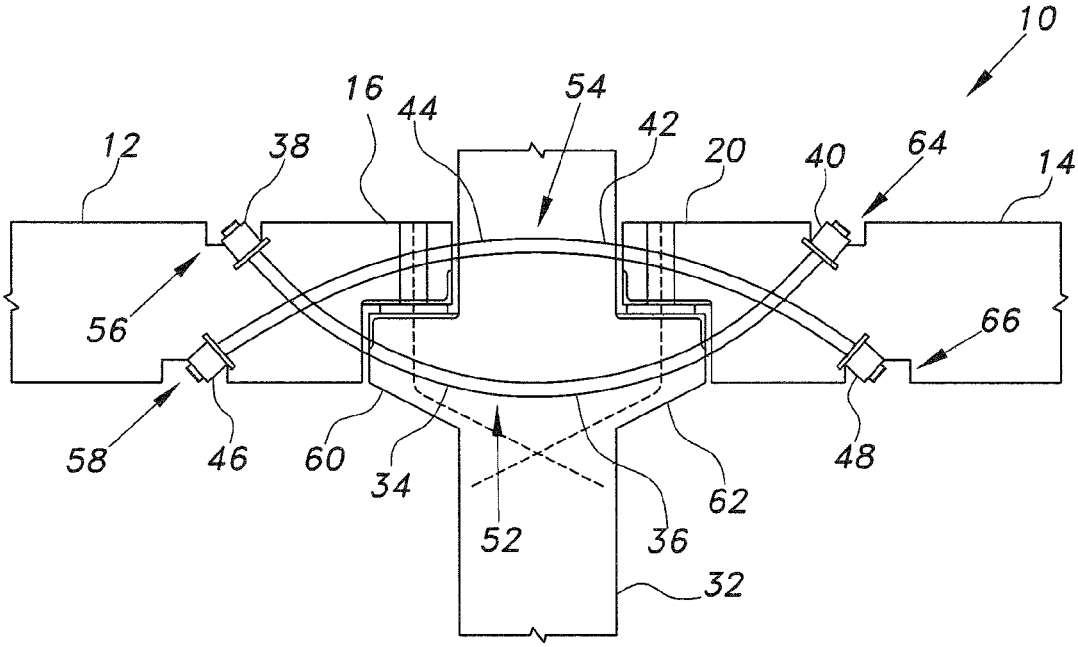
FIG. 6 is a side view in section of the reinforced concrete construction elements with pre-stressing connectors.

As shown in FIGS. 1, 3 and 6, the reinforced concrete construction elements 10 include first and second beams, 12, 14, respectively. The first beam 12 has longitudinally opposed first and second ends, 16, 18, respectively, a top face 24 and a bottom face 26. Similarly, the second beam 14 has longitudinally opposed first and second ends, 20, 22, respectively, a top face 28 and a bottom face 30. The first ends 16, 20 of each of the first and second beams 12, 14, respectively, are secured to a central column 32. As shown, column 32 may include a pair of corbels 60, 62, such that the first ends 16, 20 of each of the first and second beams 12, 14, respectively, are supported by, and connected to, the corbels 60, 62. First and second beams 12, 14 and column 32 may be formed from any suitable type of reinforced concrete, and it should be understood that the overall contouring, configuration and relative dimensions of first and second beams 12, 14 and column 32 are shown for exemplary purposes only. In FIGS. 1 and 3, the second ends 18, 22 of first and second beams 12, 14 are each shown joined to further columns. It should be understood that these may be terminating columns (as in the embodiment of FIG. 7) or what is shown may represent only a portion of further, continuous column-beam connections.

As best shown in FIGS. 3 and 6, column 32 has at least two passive ducts 52, for passive pre-stressing tendons, and at least two active ducts 54, for active pre-stressing tendons, formed therethrough. At least two passive pre-stressing tendons 34 and at least two active pre-stressing tendons 42 are provided, as noted above. Each passive pre-stressing tendon 34 has opposed first and second ends 38, 40, respectively, and an arcuately-shaped contour. The first end 38 is anchored to the top face 24 of the first beam 12, and the second end 40 is anchored to the top face 28 of the second beam 14, such that each passive pre-stressing tendon 34 has a concave contour with a central low point. A central portion 36 of the passive pre-stressing tendon 34 passes through a corresponding one of the passive ducts 52 formed through the column 32. Similarly, each active pre-stressing tendon 42 has opposed first and second ends 46, 48, respectively, and an inverted arcuately-shaped contour. However, the first end 46 is anchored to the bottom face 26 of the first beam 12, and the second end 48 is anchored to the bottom face 30 of the second beam 14, such that each active pre-stressing tendon 42 has a convex contour with a central high point. A central portion 44 of the active pre-stressing tendon 42 passes through a corresponding one of the active ducts 54 formed through the column 32.

As shown, the first ends 16, 20 of the first and second beams 12, 14, respectively, may each have at least two top recesses 56, 64, respectively, and at least two bottom recesses 58, 66, respectively, formed therein. The first ends 38 of the at least two passive pre-stressing tendons 34 are anchored in corresponding ones of the top recesses 56 of the first beam 12, and the second ends 40 of the at least two passive pre-stressing tendons 34 are anchored in corresponding ones of the top recesses 64 of the second beam. Similarly, the first ends 46 of the at least two active pre-stressing tendons 42 are anchored in corresponding ones of the bottom recesses 58 of the first beam, and the second ends 48 of the at least two active pre-stressing tendons 42 are anchored in corresponding ones of the bottom recesses 66 of the second beam 14. It is important to note that FIGS. 1-7 show exemplary cut, or dapped, beam ends, but it should be understood that the present invention may be applied to any suitable type of beam-and-column combinations, such as, for example, beams with prismatic ends.

Figure 4:
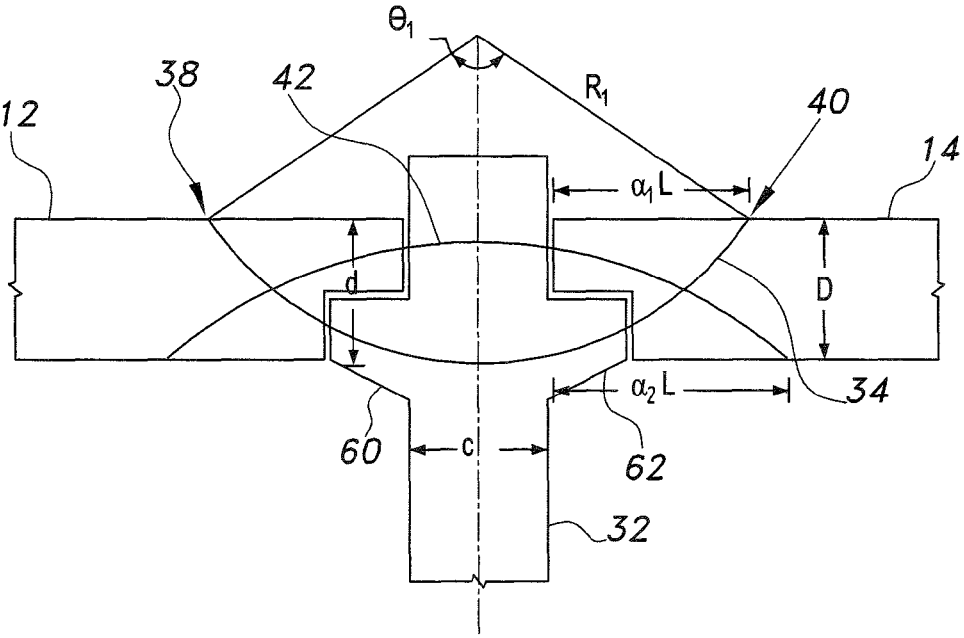
FIG. 4 is a partial diagrammatic view of the reinforced concrete construction elements with pre-stressing connectors of FIG. 1.

In the following analysis, which corresponds to FIG. 4, although the tendon profiles of the active and passive pre-stressing tendons 42, 34, respectively, may be parabolic or circular, a parabolic shape is approximated by a substantially equivalent circular shape, for purposes of simplification. As shown in FIG. 4, the radius of curvature of the passive tendon 34, $R_1$, is given by $$R_1 = \frac{\left(\alpha_1 L + \frac{c}{2}\right)^2}{2d} + \frac{d}{2},$$

where c is the width of column 32, d is the effective depth of each of first and second beams 12, 14, L is the span of each of first and second beams 12, 14, and $\alpha_1 L$ is the distance of the anchorage point from each beam end along the longitudinal axis of the beam; i.e., $\alpha_1 L$ is the longitudinal distance between column 32 and second end 40 of passive pre-stressing tendon 34. Preferably, the set of reinforced concrete construction elements with pre-stressing connectors 10 are arranged symmetrically about column 32, thus $\alpha_1 L$ is also the longitudinal distance between column 32 and first end 38 of passive pre-stressing tendon 34.

Figure 5:
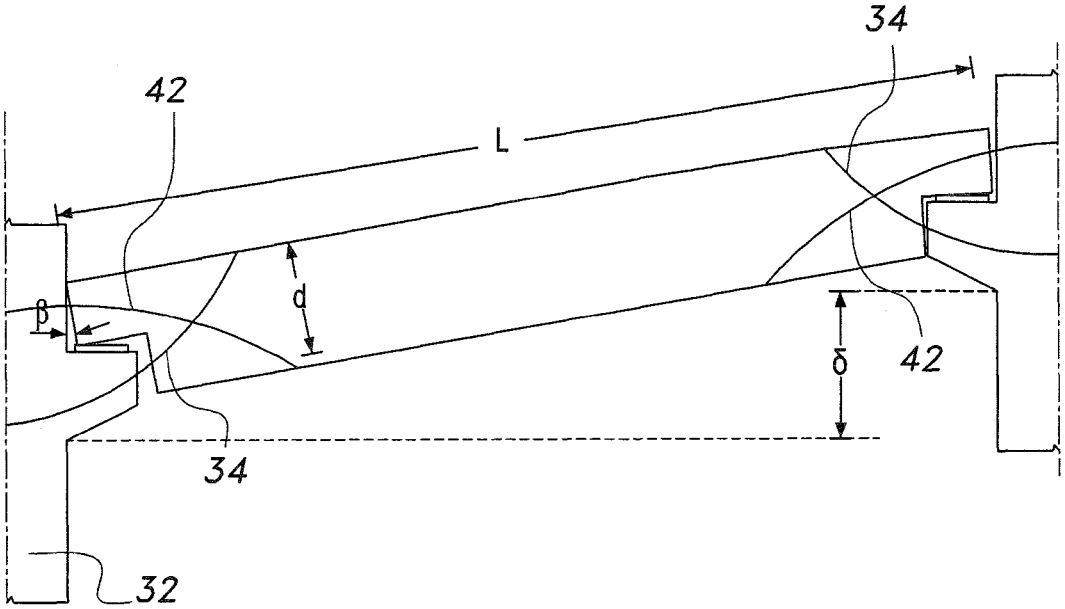
FIG. 5 diagrammatically illustrates the reinforced concrete construction elements with pre-stressing connectors in a configuration undergoing column damage.

As shown in FIG. 5, when column 32 is damaged by a blast load, for example, there will be a vertical downward movement, δ, of the beam-column connection, thus causing an angular rotation of the beams (represented by β in FIG. 5), which is given by $$\beta = \frac{\delta}{L}.$$

For purposes of simplification, this assumes that first and second beams 12, 14 remain straight with no damage to either beam or corbels 60, 62. In reality, the angle β will typically be lower.

The downward vertical movement of the joint causes extension in the length of passive tendon 34 at its connection to the damaged column 32, resulting in an incremental strain in tendon 34. The incremental strain can be given by $$\Delta\varepsilon_1 = \frac{2\beta d}{R_1\theta_1} = \frac{2d\delta}{LR_1\theta_1},$$

where $\theta_1$, as shown, is the angle subtended by passive tendon 34 between the anchor points at its center of curvature. The stress increment corresponding to the above strain is given by $$\Delta\sigma_1 = E\Delta\varepsilon_1 = \frac{2d\delta E}{LR_1\theta_1}.$$

If the far ends of beams are connected to interior columns, the stress increment in the active tendon 42 at the far ends will be less than half of this value because of the other beam at the far end being unaffected and the active tendon 42 being longer. Assuming the yield stress of the pre-stressing tendon occurring at 1% elongation, the vertical displacement of connection for the development of yield stress can be calculated from $$\delta = \frac{0.009LR_1\theta_1}{2d}.$$

Here, the initial stress in the passive tendon 34 is taken as 10% of the yield stress. Taking the length of the passive tendon 34 as approximately half of the beam length (i.e., $R_1\theta_1 \sim L/2$) and d=L/10, the vertical displacement of the joint for the development of yield stress is 2.25% of L. Assuming the ultimate strain of the pre-stressing tendon as 8%, the joint can move downwardly up to ~20% of L before the fracture point, but the development of additional stresses in the passive tendons 34 will hold the vertical downward movement of the joint.

The number and size of the active pre-stressing tendons 42 will ultimately be based on the structural design requirements and the sizes of the construction elements, whereas the number and size of the passive tendons 34 should be kept the same as those of the active tendons 42. Since the active tendons 42 may correspond to a bending moment of approximately $\alpha wL^2$ (where w is the total load per unit length of the beam and α may vary from 0.0625 to 0.1), the passive tendons 34 may be enough to resist an equivalent bending moment. This is expected to be more than the maximum net sagging bending moment to be resisted by the beam after taking into consideration the flexural resistance of floor slabs. The rotation of the far end of the beam will be less due to the active pre-stressing tendons 42, which bend the beam.

Preferably, the active pre-stressing tendons 42 are longer than the passive pre-stressing tendons 34, which allows for staggering of the anchoring points, thus avoiding stress concentration at a particular section due to the anchor points. For example, the anchorage of active pre-stressing tendons 42 may be at a point approximately L/4 from the beam end, whereas the anchor point of the passive pre-stressing tendons 42 may be at a point approximately L/5 from the beam end (where L is the length of the beam, as described above).

Figure 7:
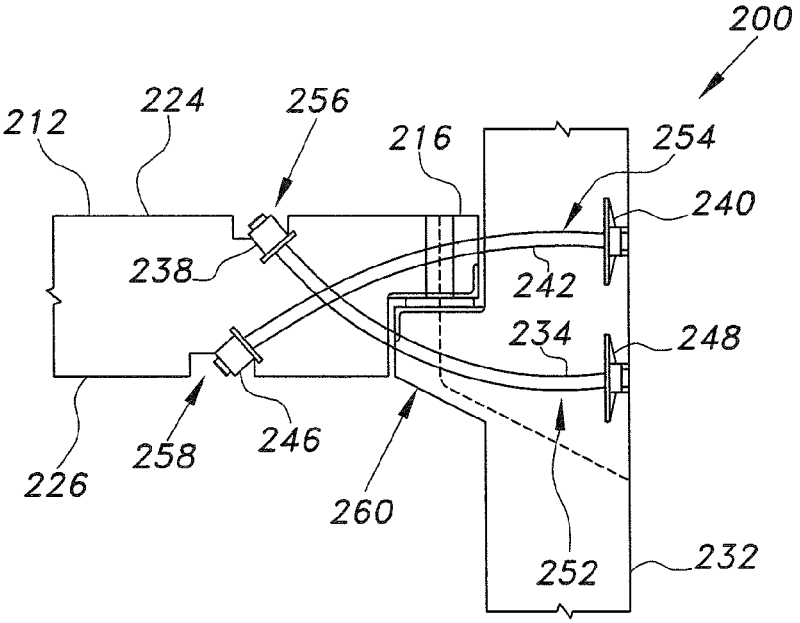
FIG. 7 is a side view in section of an alternative embodiment of the reinforced concrete construction elements with pre-stressing connectors for an end column.

In the alternative embodiment of FIG. 7, the set of reinforced concrete construction elements with pre-stressing connectors 200 includes only a single beam 212, which is connected to column 232 at one end 216 (which may be supported by corbel 260, as in the previous embodiment). As in the previous embodiment, at least two passive pre-stressing tendons 234 and at least two active pre-stressing tendons 242 are provided. Each passive pre-stressing tendon 234 has opposed first and second ends 238, 248, respectively, and a substantially U-shaped contour. The first end 238 is anchored to the top face 224 of the beam 212 (within a recess 256, as in the previous embodiment), and the second end 248 is anchored to the column 232. A portion of pre-stressing tendon 242 passes through a corresponding one of the passive ducts 252 formed through the column 232. Similarly, each active pre-stressing tendon 242 has opposed first and second ends 246, 240, respectively, and an arcuately-shaped contour. The first end 246 is anchored to the bottom face 226 of the beam 212 (in a recess 258, as in the previous embodiment), and the second end 240 is anchored to the column 232. A portion of active pre-stressing tendon 242 passes through a corresponding one of the active ducts 254 formed through the column 232.

It is to be understood that the present invention is not limited to the embodiments described above, but encompasses any and all embodiments within the scope of the following claims.

We claim:

1. A set of precast reinforced concrete construction elements with pre-stressing connectors, comprising:

first and second beams, each beam having longitudinally opposed first and second ends, a top face and a bottom face;

a column, wherein the first ends of each of said first and second beams are secured to the column, at least two passive ducts and at least two active ducts being formed through said column and the first ends of each of the first and second beams;

at least two passive pre-stressing tendons, wherein each said passive pre-stressing tendon has a first predetermined length and opposed first and second ends and an upwardly extending arcuately-shaped contour, the first end thereof being anchored to the top face of said first beam, the second end thereof being anchored to the top face of said second beam, a central portion thereof passing through a corresponding one of the passive ducts formed through said column; and at least two active pre-stressing tendons, wherein each said active pre-stressing tendon has a second predetermined length and opposed first and second ends and an inverted arcuately-shaped contour, the first end thereof being anchored to the bottom face of said first beam, the second end thereof being anchored to the bottom face of said second beam, a central portion thereof passing through a corresponding one of the active ducts formed through said column, wherein the second predetermined length is greater than the first predetermined length.

2. The set of precast reinforced concrete construction elements with pre-stressing connectors as recited in claim 1, wherein the first ends of said first and second beams each have at least two top recesses and at least two bottom recesses formed therein, the first ends of the at least two passive pre-stressing tendons being anchored in corresponding ones of the top recesses of said first beam, the second ends of the at least two passive pre-stressing tendons being anchored in corresponding ones of the top recesses of said second beam, the first ends of the at least two active pre-stressing tendons being anchored in corresponding ones of the bottom recesses of said first beam, and the second ends of the at least two active pre-stressing tendons being anchored in corresponding ones of the bottom recesses of said second beam.

3. The set of precast reinforced concrete construction elements with pre-stressing connectors as recited in claim 1, wherein said column further comprises first and second corbels, wherein the first ends of said first and second beams are respectively connected to, and supported by, the first and second corbels.

4. A set of precast reinforced concrete construction elements with pre-stressing connectors, comprising:

a beam having an end, a top face and a bottom face;

an end column, the end column having an inner face and an outer face, wherein said end of the beam is secured to the inner face of the column, at least two passive ducts and at least two active ducts being formed through said column and said end of the beam;

at least two passive pre-stressing tendons, wherein each said passive pre-stressing tendon has a first predetermined length and opposed first and second ends and an upwardly extending arcuately-shaped contour, the first end thereof being anchored to the top face of said beam, the second end thereof being anchored to the outer face of said column, a portion thereof passing through a corresponding one of the passive ducts formed through said column; and at least two active pre-stressing tendons, wherein each said active pre-stressing tendon has a second predetermined length and opposed first and second ends and an inverted arcuately-shaped contour, the first end thereof being anchored to the bottom face of said beam, the second end thereof being anchored to the outer face of said column, a portion thereof passing through a corresponding one of the active ducts formed through said column, wherein the second predetermined length is greater than the first predetermined length.

5. The set of precast reinforced concrete construction elements with pre-stressing connectors as recited in claim 4, wherein the beam has at least two top recesses and at least two bottom recesses formed therein, the first ends of the at least two passive pre-stressing tendons being anchored in corresponding ones of the top recesses of said beam, the first ends of the at least two active pre-stressing tendons being anchored in corresponding ones of the bottom recesses of said beam.

6. The set of precast reinforced concrete construction elements with pre-stressing connectors as recited in claim 4, wherein said column further comprises a corbel, wherein the beam is connected to, and supported by, the corbel.

* * * * *